US006938600B2

(12) United States Patent
Rotter et al.

(10) Patent No.: US 6,938,600 B2
(45) Date of Patent: Sep. 6, 2005

(54) AUTOMATIC COMPRESSION RELEASE MECHANISM INCLUDING FEATURE TO PREVENT UNINTENTIONAL DISABLEMENT DURING ENGINE SHUTDOWN

(75) Inventors: Terrence M. Rotter, Sheboygan Falls, WI (US); Phillip L. Bettenhausen, deceased, late of Sheboygan Falls, WI (US); by Larry W. Bettenhausen, legal representative, Ashland, WI (US); Theodore E. Wehrman, Sheboygan, WI (US); Scott X. Chen, Sheboygan, WI (US); Yun Huang, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/921,531

(22) Filed: Aug. 19, 2004

(65) Prior Publication Data

US 2005/0109304 A1 May 26, 2005

Related U.S. Application Data

(60) Provisional application No. 60/496,433, filed on Aug. 20, 2003.

(51) Int. Cl.[7] ..... F01L 13/08

(52) U.S. Cl. ..... 123/182.1

(58) Field of Search ..... 123/182.1

(56) References Cited

U.S. PATENT DOCUMENTS

| | | | | |
|---|---|---|---|---|
| 3,362,390 | A * | 1/1968 | Esty | 123/182.1 |
| 4,672,930 | A * | 6/1987 | Sumi | 123/182.1 |
| 4,696,266 | A * | 9/1987 | Harada | 123/182.1 |
| 6,672,269 | B1 * | 1/2004 | Bonde et al. | 123/182.1 |
| 2004/0003791 | A1 * | 1/2004 | Ghelfi et al. | 123/182.1 |

* cited by examiner

*Primary Examiner*—Henry C. Yuen
*Assistant Examiner*—Arnold Castro
(74) *Attorney, Agent, or Firm*—Quarles & Brady LLP

(57) ABSTRACT

An automatic compression release mechanism for in an internal combustion engine, includes a camshaft assembly including a cam gear, a cam lobe with a notch positioned along a first side of the gear, a tube passing through the cam gear and aligned with the notch, and a support on a second side of the cam gear. An actuator assembly includes a contoured shaft that extends through the tube and resides in the notch. The actuator assembly is rotatable between two operating orientations and a step formed in the surface of the notch prevents the actuator from becoming disabled during engine shut down.

20 Claims, 6 Drawing Sheets

AUTOMATIC COMPRESSION RELEASE MECHANISM INCLUDING FEATURE TO PREVENT UNINTENTIONAL DISABLEMENT DURING ENGINE SHUTDOWN

CROSS-REFERENCE TO RELATED APPLICATIONS

This application claims the benefit of U.S. provisional patent application No. 60/496,433, filed on Aug. 20, 2003.

FIELD OF THE INVENTION

The present invention relates to internal combustion engines and, more particularly, to automatic compression release mechanisms employed in internal combustion engines.

BACKGROUND OF THE INVENTION

Automatic compression release mechanisms are employed in internal combustion engines to provide for improved engine performance at a variety of engine speeds. Such mechanisms typically include a component which is actuated based upon engine speed, that varies an exterior surface characteristic of a cam lobe along which mating valve train components actuate exhaust and/or intake valves of the engine. When the engine is cranking, a protrusion is created on the cam lobe such that the exhaust valve opens slightly during the compression stroke of the engine. The reduced compression caused by this "low speed orientation" reduces the effort to start the engine. However, when engine speeds are higher, such as during normal operation or idling, the protrusion is eliminated such that the exhaust valve remains closed during the compression stroke of the engine. This "normal speed orientation" maximizes engine power.

Automatic compression release mechanisms of this type often employ a weight assembly that is rotatably affixed to a portion of the camshaft such as a cam gear. As the camshaft rotates, centrifugal forces acting on the weight cause the weight to move radially outwards, away from the camshaft axis. However, the weight is typically biased by a spring towards the camshaft so that when the engine is at low speeds, the weight is pulled inward toward the camshaft. Because the movement of the weight is dependent upon the rotational speed of the camshaft, the movement of the weight can be used to govern components associated with the cam lobe to produce the desired speed-dependent variation in cam lobe shape. Commonly these components include a contoured shaft having a recessed side and an unrecessed side, which is coupled to the weight. The contoured shaft is disposed in a notch formed in the surface of the cam lobe, and when the weight is disposed radially inwards at low engine speed, the unrecessed side of the contoured shaft extends outward beyond the exterior surface of the cam lobe producing a protrusion. When the weight is rotated outwards at higher engine speeds, the recessed side of the contoured shaft faces outward and the protrusion on the cam lobe is largely or entirely eliminated.

In many engines, it is desirable to employ an automatic compression release mechanism having as few components as possible, in order to simplify and consequently reduce the costs of the mechanism. This can be achieved to some extent by integrally forming as a single piece assembly the weight and the contoured shaft such that rotation of the weight directly causes rotation of the contoured shaft. For similar cost-related reasons, it often is desirable for engines to employ simply-formed and inexpensive components throughout the cam shaft assembly. For example, the cam gear can be molded out of plastic or die cast as a single piece. Also, the cam lobe can be integrally formed as part of the cam gear, or at least fixedly attached to the cam gear.

When shutting down any engine, its rotation is slowed both by friction and by the work of the piston against gasses in the cylinder during the compression stroke. During this shut down the contoured shaft rotates to the low speed orientation in which the protrusion is exposed on the cam surface. If at the final moments of rotation there is insufficient angular momentum to accomplish the compression event, however, the compressed gas will work against the piston to cause a small amount of reversed rotation. This small reversed rotation of the engine can cause the cam follower to bear against the recessed, or flat side of the contoured shaft and rotate it against the bias spring force to its normal speed orientation. The automatic compression release mechanism thus becomes disabled for the subsequent starting event, thus making it difficult to restart the engine due to the high compressive forces.

SUMMARY OF THE INVENTION

The present invention is an improvement to an automatic compression release mechanism which prevents it from becoming disabled during engine shut down. More specifically, the improvement is a step formed in the notch which rotatably supports the contoured shaft along the surface of the cam lobe. This step blocks or prevents, the contoured shaft from being rotated by the cam follower when the engine rotates in reverse direction during shut down.

In particular, the present invention relates to an improvement in an automatic compression release mechanism having a weight assembly for rotating a contoured shaft in a notch of a cam lobe between a low speed orientation in which the contoured shaft presents a first surface that protrudes above a cam lobe surface and a normal speed orientation in which the contoured shaft presents a second surface that is substantially flush with the cam lobe surface. The improvement includes a step formed in the notch of the cam lobe which interacts with the contoured shaft to resist rotation of the contoured shaft from the low speed orientation to the normal speed orientation when the cam lobe moves in a first direction of rotation during engine shut down that is opposite a second direction of rotation of the cam lobe during normal engine operation.

The present invention additionally relates to a camshaft assembly that includes a cam lobe having a recess, a cam gear coupled to the cam lobe, and an actuator assembly including a weight and a shaft coupled to one another. The actuator assembly is supported in relation to the cam lobe so that the shaft extends into the recess. The shaft of the actuator assembly is configured so that during low speed rotation of the cam lobe a protuberance formed by a portion of the shaft extends out of the recess beyond a perimeter of the cam lobe, and during normal speed rotation of the cam lobe the protuberance is at least one of reduced and eliminated. Further, the recess includes two curved surfaces that are connected by a step surface, and the step surface restricts rotational movement of the shaft at least some of the time.

The present invention further relates to a method of operating a camshaft assembly. The method includes decelerating a rotational speed of the camshaft assembly from a first speed to a second speed, where the camshaft assembly is rotating in a first rotational direction and, as the camshaft assembly is decelerating, rotating a shaft of an actuator assembly of the camshaft assembly within a recess of a cam lobe of the camshaft assembly, so that a protuberance appears on the cam lobe. The method additionally includes receiving an axially extending edge of the shaft adjacent to an axially extending step formed in the recess, where in at least one operational situation the shaft is prevented from rotating in a manner that would cause the edge to pass by the step.

DESCRIPTION OF THE PREFERRED EMBODIMENT

Figure 1:
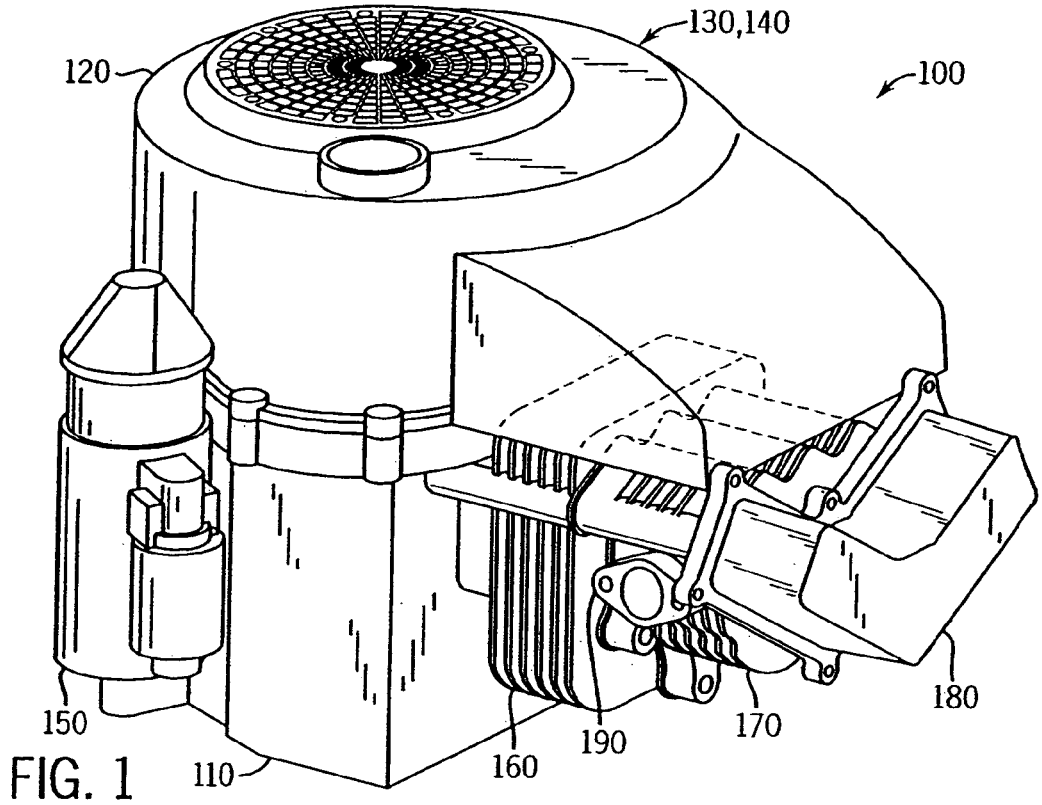
FIG. 1 is a first perspective view of a single cylinder engine, taken from a side of the engine on which are located a starter and cylinder head.
Figure 2:
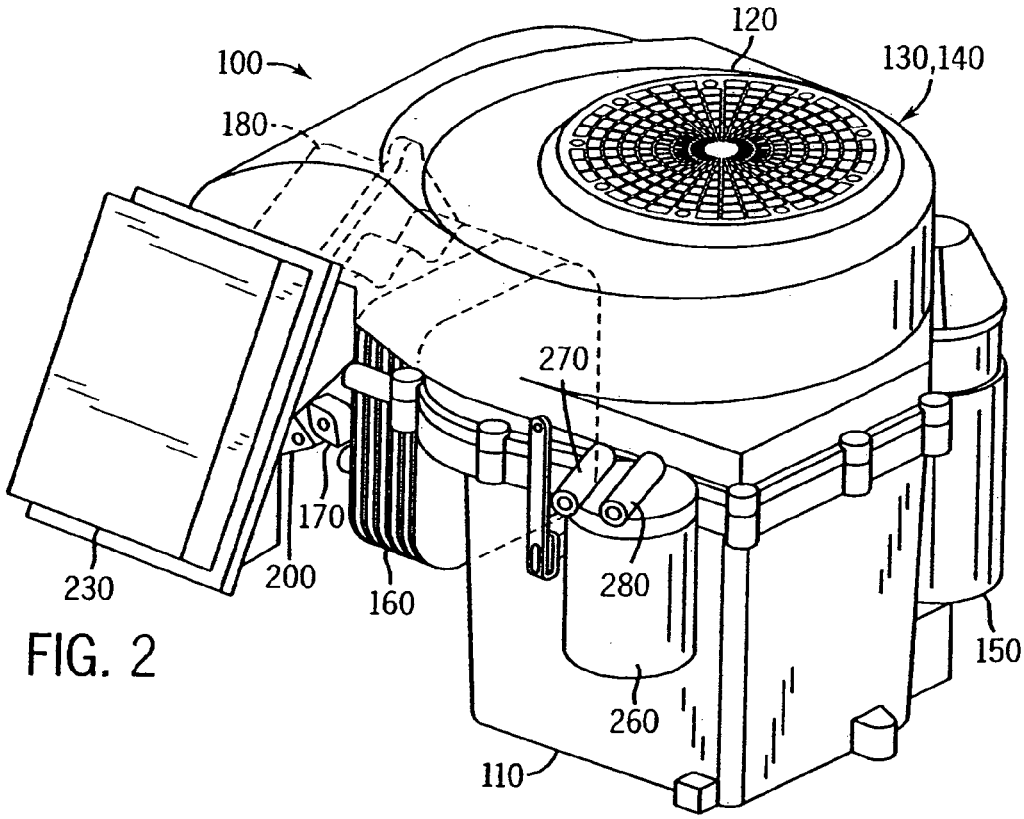
FIG. 2 is a second perspective view of the single cylinder engine of FIG. 1, taken from a side of the engine on which are located an air cleaner and oil filter.

Referring to FIGS. 1 and 2, a single cylinder, 4-stroke, internal combustion engine 100 includes a crankcase 110 and a blower housing 120, inside of which are a fan 130 and a flywheel 140. The engine 100 further includes a starter 150, a cylinder 160, a cylinder head 170, and a rocker arm cover 180. Attached to the cylinder head 170 are an air exhaust port 190 shown in FIG. 1 and an air intake port 200 shown in FIG. 2. As is well known in the art, during operation of the engine 100, a piston 210 (see FIG. 7) moves back and forth within the cylinder 160 towards and away from the cylinder head 170. The movement of the piston 210 in turn causes rotation of a crankshaft 220 (see FIG. 7), as well as rotation of the fan 130 and the flywheel 140, which are coupled to the crankshaft. The rotation of the fan 130 cools the engine, and the rotation of the flywheel 140, causes a relatively constant rotational momentum to be maintained.

Referring specifically to FIG. 2, the engine 100 further includes an air filter 230 coupled to the air intake port 200, which filters the air required by the engine prior to the providing of the air to the cylinder head 170. The air provided to the air intake port 200 is communicated into the cylinder 160 by way of the cylinder head 170, and exits the engine by flowing from the cylinder through the cylinder head and then out of the air exhaust port 190. The inflow and outflow of air into and out of the cylinder 160 by way of the cylinder head 170 is governed by an input (intake) valve 240 and an output (exhaust) valve 250, respectively (see FIG. 8). Also as shown in FIG. 2, the engine 100 includes an oil filter 260 through which the oil for the engine 100 is passed and filtered. Specifically, the oil filter 260 is coupled to the crankcase 110 by way of incoming and outgoing lines 270, 280, respectively, whereby pressurized oil is provided into the oil filter and then is returned from the oil filter to the crankcase.

Figure 3:
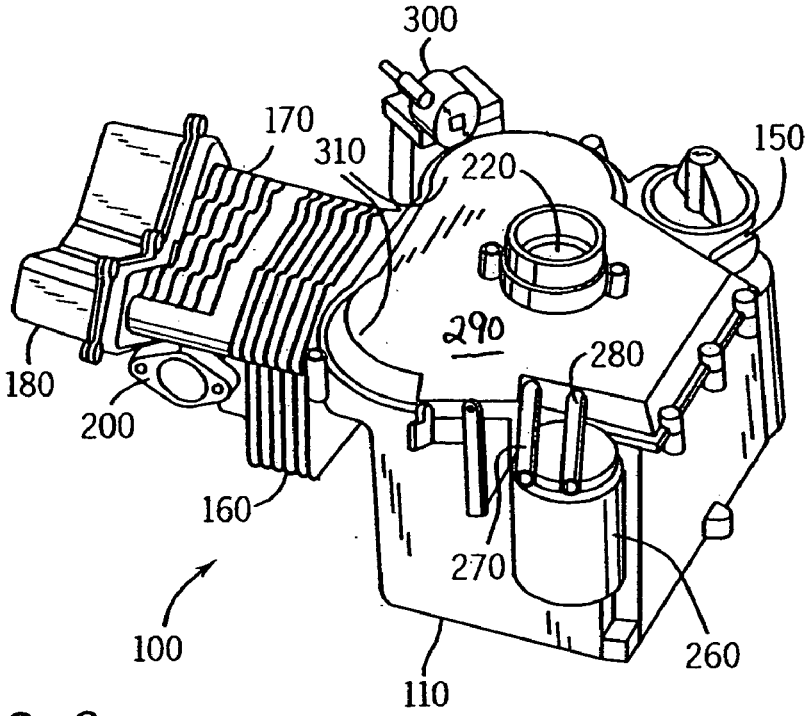
FIG. 3 is a third perspective view of the single cylinder engine of FIG. 1, in which certain parts of the engine have been removed to reveal additional internal parts of the engine.
Figure 4:
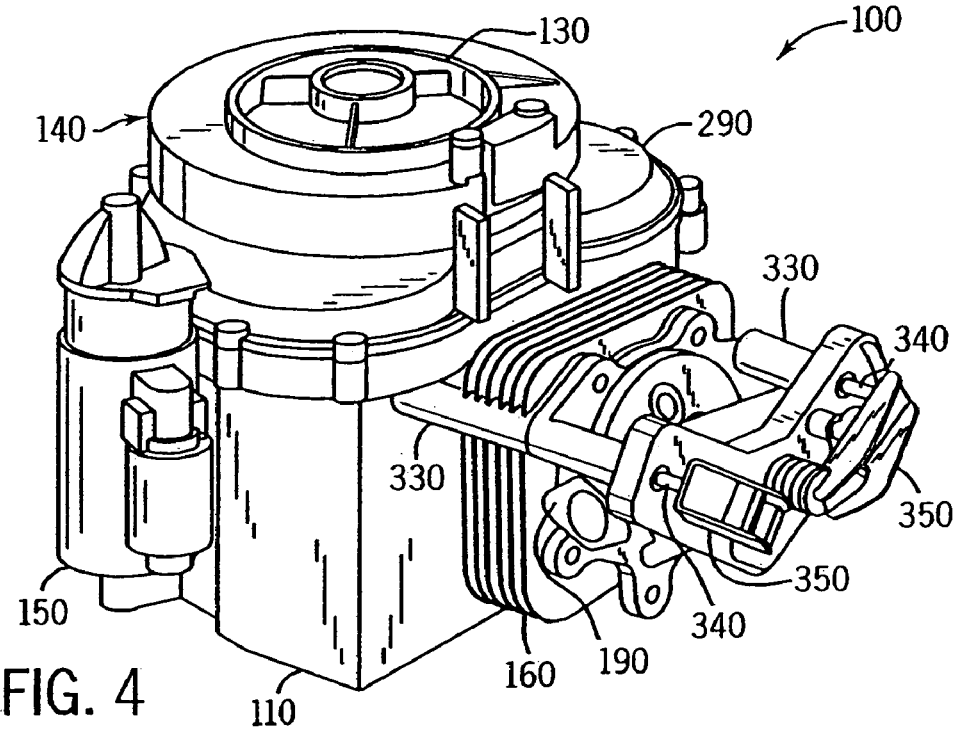
FIG. 4 is a fourth perspective view of the single cylinder engine of FIG. 1, in which certain parts of the engine have been removed to reveal additional internal parts of the engine.

Referring to FIGS. 3 and 4, the engine 100 is shown with the blower housing 120 removed to expose a top 290 of the crankcase 110. With respect to FIG. 3, in which both the fan 130 and the flywheel 140 are also removed, a coil 300 is shown that generates an electric current based upon rotation of the fan 130 and/or the flywheel 140, which together operate as a magneto. Additionally, the top 290 of the crankcase 110 has a pair of lobes 310 that cover a pair of cam gears 320 (see FIGS. 5 and 7–8). As shown in FIG. 4, the fan 130 and the flywheel 140 are above the top 290 of the crankcase 110. Additionally, FIG. 4 shows the engine 100 without the rocker arm cover 180, to more clearly reveal a pair of tubes 330 through which extend a pair of respective push rods 340. The push rods 340 extend between a pair of respective rocker arms 350 and a pair of cams 360 (see FIG. 8) within the crankcase 110, as discussed further below.

Figure 5:
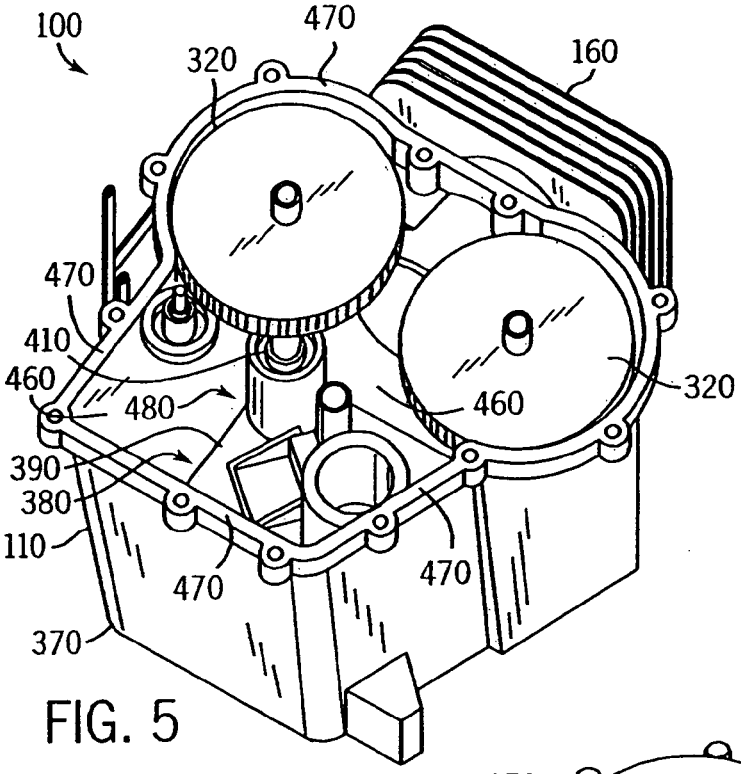
FIG. 5 is fifth perspective view of portions of the single cylinder engine of FIG. 1, in which a top of the crankcase has been removed to reveal an interior of the crankcase.
Figure 6:
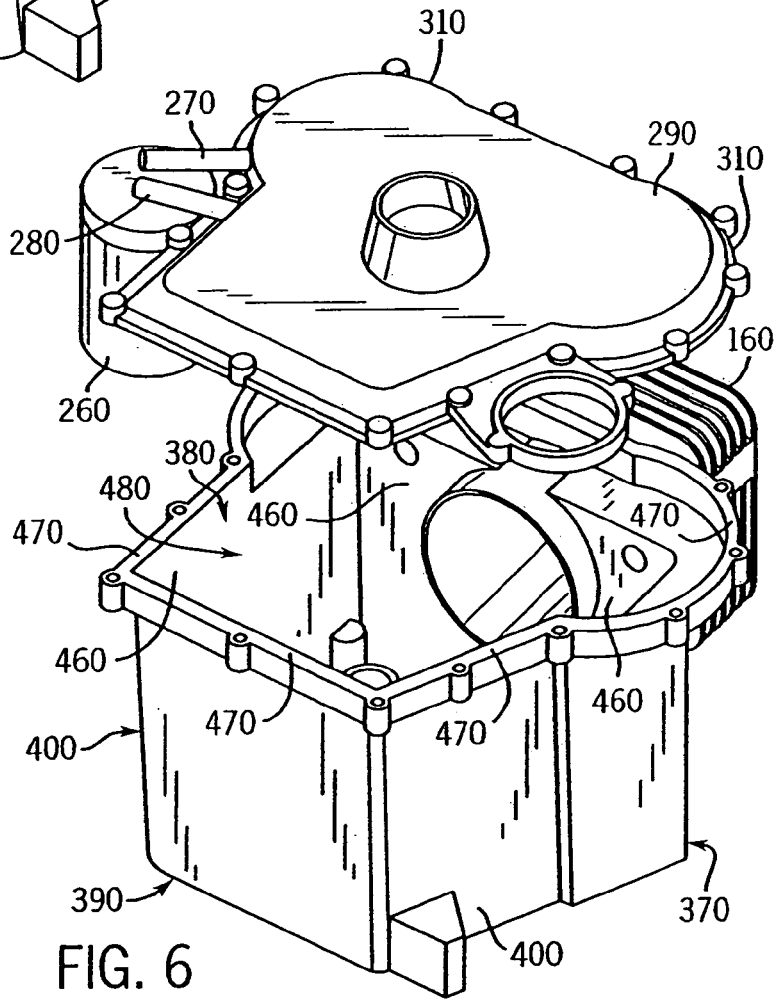
FIG. 6 is a sixth perspective view of portions of the single cylinder engine of FIG. 1, in which the top of the crankcase is shown exploded from the bottom of the crankcase.

Turning to FIGS. 5 and 6, the engine 100 is shown with the top 290 of the crankcase 110 removed from a bottom 370 of the crankcase 110 to reveal an interior 380 of the crankcase. Additionally in FIGS. 5 and 6, the engine 100 is shown in cut-away to exclude portions of the engine that extend beyond the cylinder 160 such as the cylinder head 170. With respect to FIG. 6, the top 290 of the crankcase 110 is shown above the bottom 370 of the crankcase in an exploded view. In this embodiment, the bottom 370 includes not only a floor 390 of the crankcase, but also all four side walls 400 of the crankcase, while the top 290 only acts as the roof of the crankcase. The top 290 and bottom 370 are manufactured as two separate pieces such that, in order to open the crankcase 110, one physically removes the top from the bottom. Also, as shown in FIG. 5, the pair of gears 320 within the crankcase 110 are integrally formed as part of, or at least supported by, respective camshafts 410, which in turn are supported by the bottom 370 of the crankcase 110.

Figure 7:
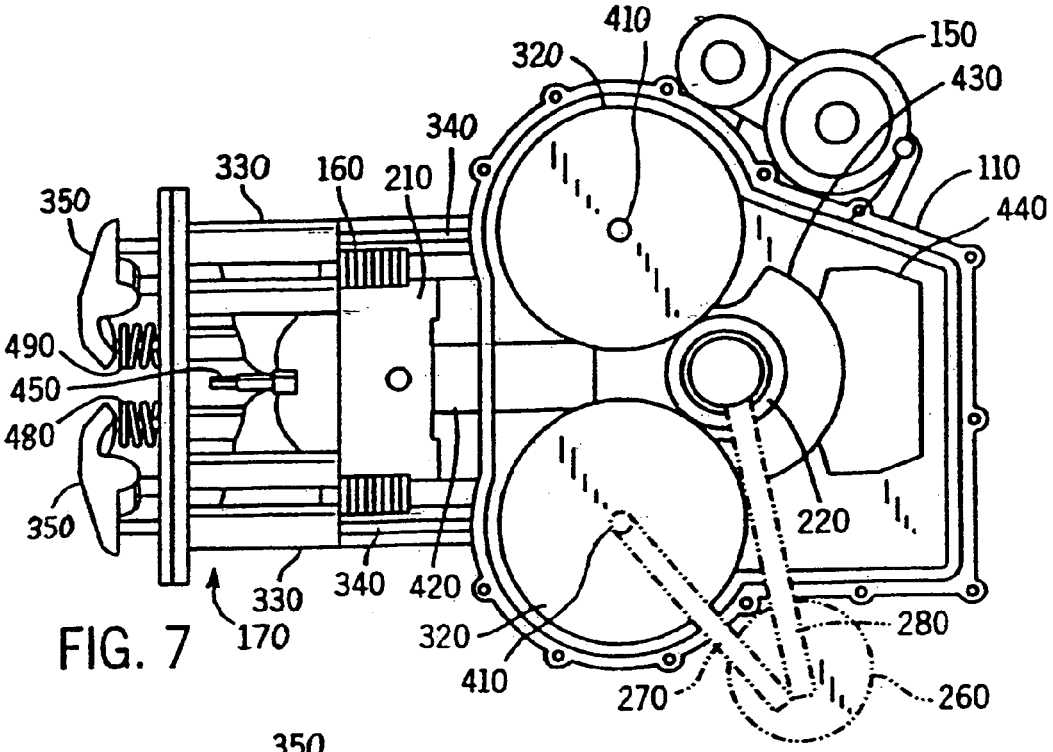
FIG. 7 is a top view of the single cylinder engine of FIG. 1, showing internal components of the engine.

Referring to FIG. 7, a top view of the engine 100 (with the top 290 of the crankcase 110 removed) is provided in which additional internal components of the engine are shown. In particular, FIG. 7 shows the piston 210 within the cylinder 160 to be coupled to the crankshaft 220 by a connecting rod 420. The crankshaft 220 is in turn coupled to a rotating counterweight 430 and reciprocal weights 440, which balance the forces exerted upon the crankshaft 220 by the piston 210. The crankshaft 220 further is in contact with each of the gears 320, and thus communicates rotational motion to the gears. In the preferred embodiment, the camshafts 410 upon which the cam gears 320 are supported are capable of communicating oil from the floor of the crankcase 110 upward to the gears 320. The incoming line 270 to the oil filter 260 is coupled to one of the camshafts 410 to receive oil, while the outgoing line 280 from the oil filter is coupled to the crankshaft 220 to provide lubrication thereto. FIG. 7 further shows a spark plug 450 located on the cylinder head 170, which provides sparks during power strokes of the engine to cause combustion to occur within the cylinder 160. The electrical energy for the spark plug 450 is provided by the coil 300 (see FIG. 3).

Figure 8:
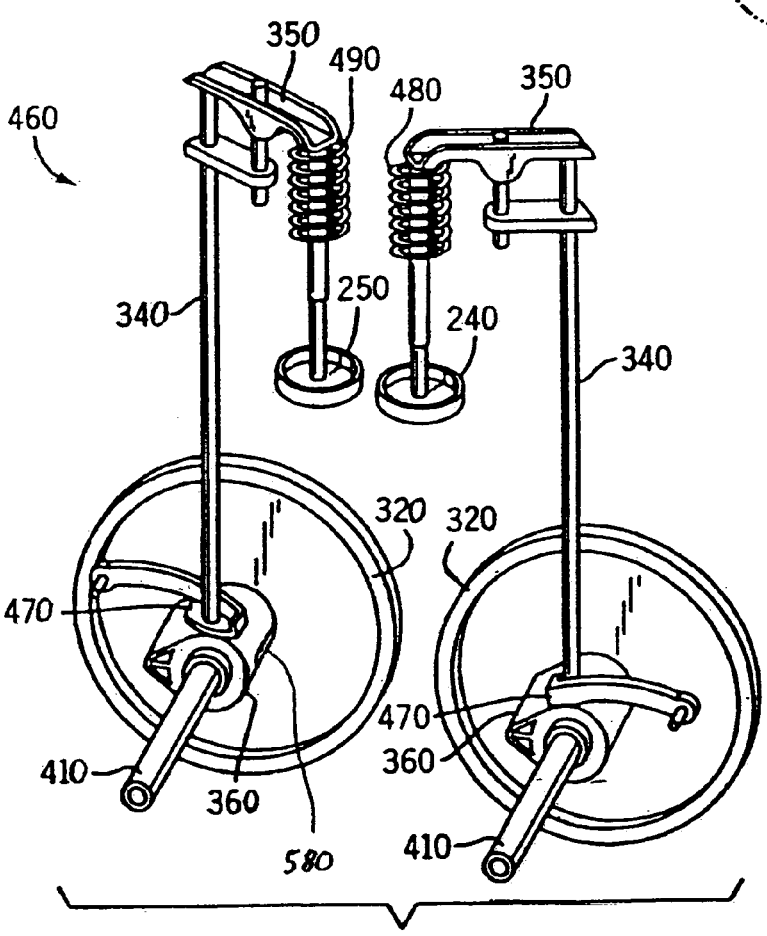
FIG. 8 is a perspective view of components of a valve train of the single cylinder engine of FIG. 1.

Referring to FIG. 7 and FIG. 8, elements of a valve train 460 of the engine 100 are shown. The valve train 460 includes cam gears 320 driven by camshafts 410 and also includes the cam lobes 360 disposed underneath the respective gears 320 and around respective camshafts 410. Cam follower arms 470 are rotatably mounted to the crankcase 110 and extend to rest upon the respective cam lobes 360. The push rods 340 in turn rest upon the respective cam follower arms 470 and as the cam lobes 360 rotate, the push rods 340 are forced outward away from the respective camshafts 410 by the cam follower arms 470 as they follow the contour of their respective cam lobes 360. This causes the rocker arms 350 to rock or rotate, and consequently causes the respective valves 240 and 250 to open and close at the proper times during the engine cycle. A pair of springs 480, 490 positioned between the cylinder head 170 and the rocker arms 350 apply a bias force to the rocker arms in a direction tending to close the valves 240,250. As a result of this bias force upon the rocker arms 350, the push rods 340 are also forced against the cam follower arms 470 and hence against the cam lobes 360.

The engine 100 is a vertical shaft engine capable of outputting 15–20 horsepower for implementation in a variety of consumer lawn and garden machinery such as lawn mowers. In alternate embodiments, the engine 100 can also be implemented as a horizontal shaft engine, be designed to output greater or lesser amounts of power, and/or be implemented in a variety of other types of machines, e.g., snowblowers. Further, in alternate embodiments, the particular arrangement of parts within the engine 100 can vary from those shown and discussed above. For example, in one alternate embodiment, the cam lobes 360 could be located above the gears 320 rather than underneath the gears.

Figure 9:
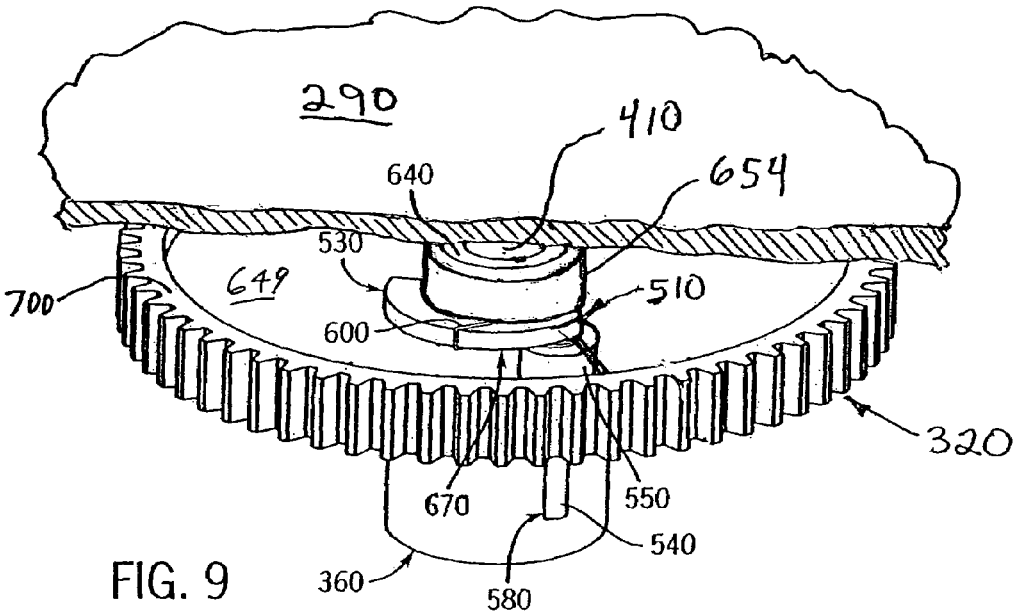
FIG. 9 is a perspective view of a camshaft, cam gear and automatic compression release (ACR) mechanism implemented in the engine of FIG. 1.
Figure 10:
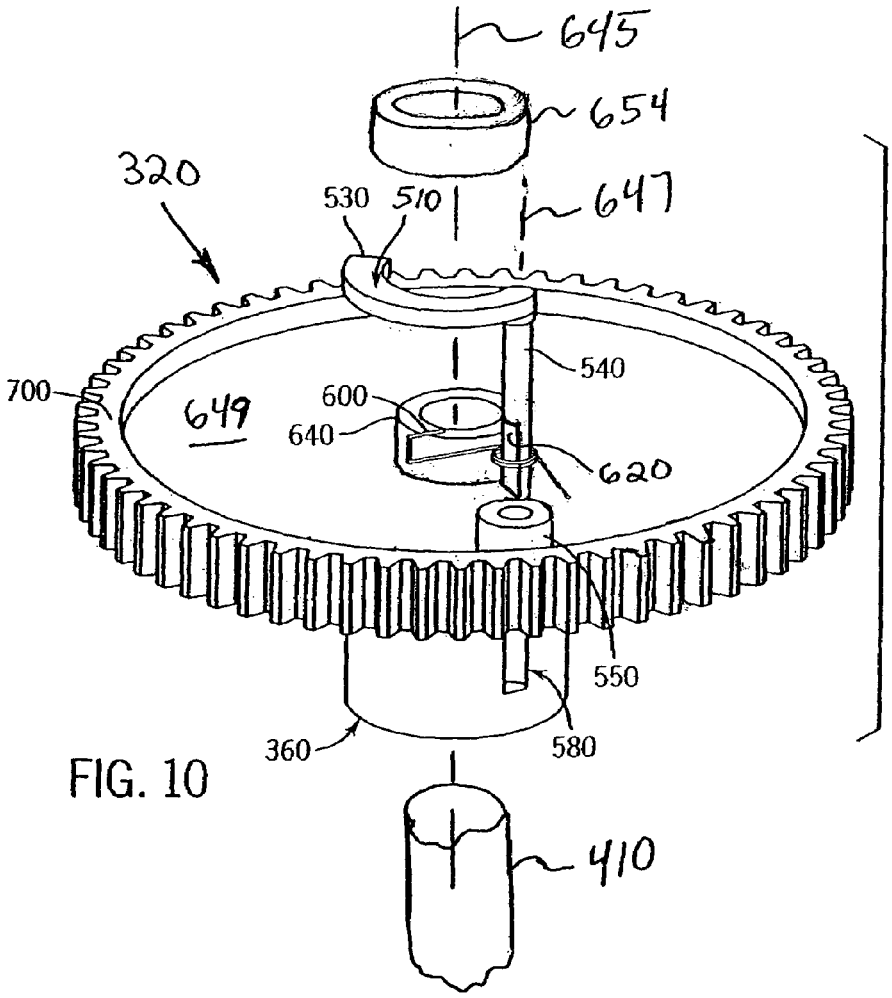
FIG. 10 is a perspective view of the camshaft, cam gear and ACR mechanism of FIG. 9, with the ACR mechanism exploded from the cam gear.

As shown in FIGS. 9 and 10, each cam gear 320 is disposed directly beneath the top cover 290 of the crankcase. A central hub 640 supports each cam gear 320 with respect to its respective cam shaft 410 for rotation about a vertical cam shaft axis 645. A web 649 extends radially outward from the hub 640 and supports a circular ring of gear teeth 700. The hub 640 and the ring of gear teeth 700 form an annular-shaped recess on the top side of each cam gear 320.

As shown in FIGS. 9 and 10, an automatic compression release (ACR) mechanism is mounted to each of the cam gears (or, in alternate embodiments, one of the cam gears) 320 and disposed in the respective recesses of the cam gears. The ACR mechanism associated with each cam gear includes an actuator assembly 510 comprised of an arc-shaped weight 530 and an integrally formed contoured shaft 540. In one embodiment, the assembly 510 is formed of powdered metal, although it may also be molded from plastic or other materials, or it may be die cast. The assembly 510 is rotatably mounted to the cam gear 320 by extending the contoured shaft 540 into and through a hollow tube 550 formed through the cam gear web 649. The contoured shaft 540 rotates about an axis 647 that is parallel to the cam shaft axis 645.

Figure 12:
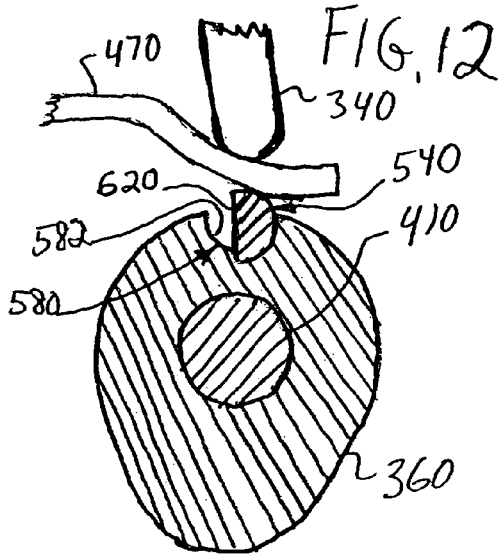
FIG. 12 is a view in cross-section through the cam lobe showing the ACR mechanism in its low speed orientation.
Figure 13:
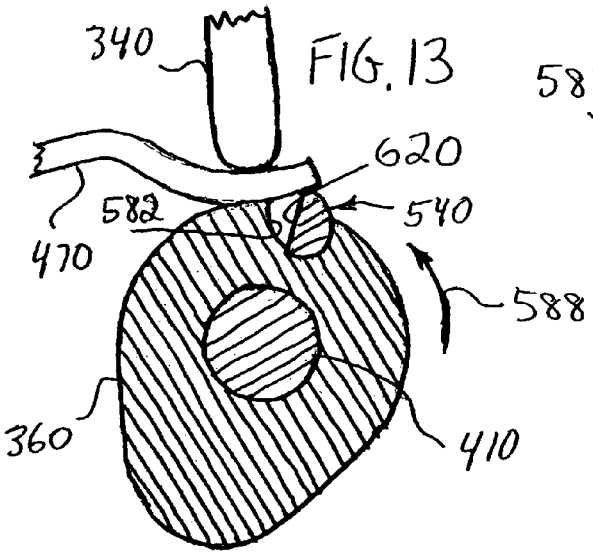
FIG. 13 is a view in cross-section through the cam lobe showing the ACR mechanism during engine shut down.
Figure 14:
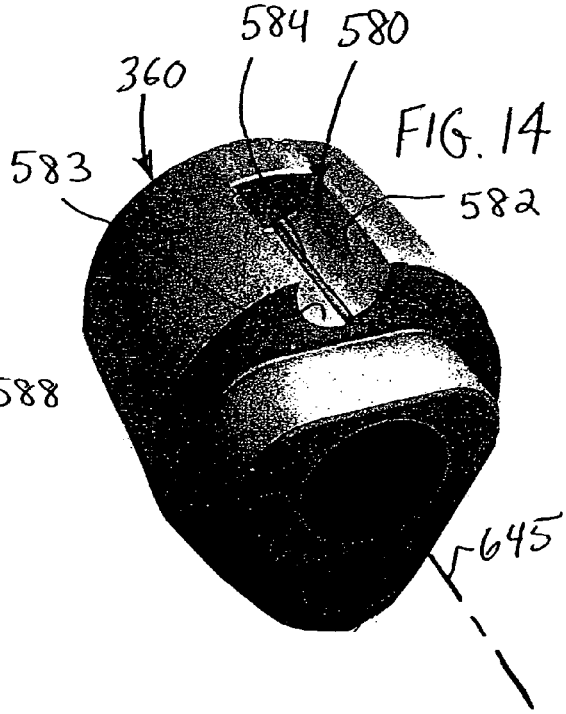
FIG. 14 is a perspective view of the cam lobe showing the recess which receives the ACR.

The top end of the contoured shaft 540 is circular in contour and connects to one end of the weight 530. It extends downward through the tube 550 and into an axially directed notch, or recess 580 formed in the cam lobe 360. The cam lobe 360 is located beneath the cam gear 320 and the lower end of the contoured shaft 540 is shaped to form a flat recessed surface 620 in its cylindrical surface. This flat surface 620 extends over the axial extent of the cam lobe recess 580 and the contoured shaft 540 has a "D-shaped" cross-section in the recess 580 as shown in FIGS. 11–13.

Figure 11:
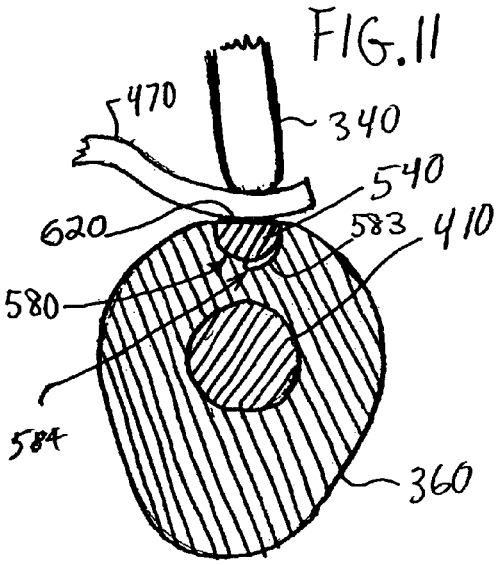
FIG. 11 is a view in cross-section through the cam lobe showing the ACR mechanism in its normal engine speed orientation.

As shown best in FIG. 11, when the assembly 510 is rotated to a normal engine speed orientation, the flat surface 620 on the contoured shaft 540 faces radially outward and it is substantially flush with the outer surface of the cam lobe 360. On the other hand, as shown in FIG. 12, when the assembly is rotated to a low engine speed orientation, the contoured shaft 540 is rotated within the recess 580 such that a portion of its D-shaped surface protrudes above the surface of the cam lobe 360. It is this protuberance which pushes upward on the push rods 340 through the cam followers 470 to open the valves 240 and 250 at low engine speed and thereby facilitate easier starting.

Referring again to FIGS. 9 and 10, the actuator assembly 510 is biased in its low engine speed orientation by a spring 600. One end of the spring 600 wraps around the weight 530 and its other end bears against a pin (not shown) formed on the cam gear 320. The spring action produced by two wraps around the top of the contoured shaft 540 biases the weight 530 against the hub 640. After the engine is started and engine speed builds, the rotation of the cam gear 320 causes the actuator assembly 510 to rotate about its axis 647 and move radially outward from the cam shaft axis 645 against the bias spring force to its normal engine speed orientation. This results from the centrifugal force produced by the rotating weight 530 which swings the arcuate-shaped weight about the axis 647. When engine speed is reduced, this centrifugal force drops and the bias spring 600 rotates the assembly 510 back to its low engine speed orientation adjacent the hub 640.

Referring still to FIGS. 9 and 10, the actuator assembly 510 is retained in place by an annular-shaped spacer 654. The spacer 654 encircles the cam shaft 410 and it fills the gap between the top of the actuator assembly 510 and the bottom surface of the crankcase cover 290. The actuator assembly 510 is thus axially retained by the spacer 654 from moving upward. It is trapped in the supporting tube 550 and constrained to rotational movement between its two operating orientations.

Referring particularly to FIGS. 11–14, an important aspect of the present invention is the shape of the axially directed recess 580 in the surface of the cam lobe 360. The recess 580 extends axially a substantial distance and it forms a trough having two curved surfaces 582 and 583. Each curved surface 582 and 583 is shaped to mate with the circular surface of the contoured shaft 540, however, they are offset from each other to form a step 584. As shown in FIG. 13, when the contoured shaft 540 is in its low engine speed orientation, one edge of its flat surface 620 engages this step 584 and inhibits its rotation to the high speed orientation. This is particularly effective when the engine reverses direction at shut down, as indicated by arrow 588. The downward pressure of the cam follower 470 acting against the opposite edge of the flat surface 620 attempts to rotate the contoured shaft, but this same downward pressure keeps the contoured shaft 540 seated against the recessed surface 583 and keeps it from lifting over the step 584 and rotating to the normal speed orientation depicted in FIG. 11.

While the step 584 is effective in blocking rotation of the actuator assembly to the normal engine speed orientation during engine shut down, it does not hinder the transition to normal engine speed during engine start up. During start up the contoured shaft 540 engages the step 584 as shown in FIG. 12 and the protruding shaft 540 relieves compression to assist starting as described above. As engine speed builds, a torque is applied to the contoured shaft 540 by the weight 530 which rotates the shaft 540 against the edge 584. In addition, the centrifugal force acting on the actuator assembly as a whole lifts the edge of the contoured shaft 540 over the step 584. To enable this to occur, the axial opening in the tube 550 (see FIG. 10) must be large enough to allow the contoured shaft 540 to align radially with both curved surfaces 582 and 583.

The interaction of the step 584 in the cam lobe recess 580 and the edge formed on the contoured shaft 540 by the flat surface 620 thus use the very pressure produced by the cam follower 470 which is the cause of the problem during engine shut down to solve the problem. During engine start up, however, this pressure is not applied for a large portion of each revolution of the cam lobe 360 and normal operation of the automatic compression release mechanism is allowed to occur. The present invention thus uses the force which causes the shut down problem to solve the problem.

While the foregoing specification illustrates and describes the preferred embodiments of this invention, it is to be understood that the invention is not limited to the precise construction herein disclosed. The invention can be embodied in other specific forms without departing from the spirit or essential attributes of the invention. For example, the present invention is applicable generally to the modification of the exterior surface of cam lobes, whether relating to the exhaust valve, intake valve, or other valves of an engine. The present invention also extends to other aspects of the design of the present camshaft assembly. For example, another aspect of the invention is the above-described means for fastening a weight and contoured shaft actuator assembly to the cam gear, where the contoured shaft extends through an opening formed in the cam gear and into the aligned notch formed in the cam lobe, and where the weight is free to rotate the contoured shaft about an axis through this opening and is axially constrained therein by a spacer disposed around a cam gear hub and extending radially outward therefrom to intercede between the cover and the weight assembly. Accordingly, reference should be made to the following claims, rather than to the foregoing specification, as indicating the scope of the invention.

What is claimed is:

1. In an automatic compression release mechanism having a weight assembly for rotating a contoured shaft in a notch of a cam lobe between a low speed orientation in which the contoured shaft presents a first surface that protrudes above a cam lobe surface and a normal speed orientation in which the contoured shaft presents a second surface that is substantially flush with the cam lobe surface, the improvement comprising:

a step formed in the notch of the cam lobe which interacts with the contoured shaft to resist rotation of the contoured shaft from the low speed orientation to the normal speed orientation when the cam lobe moves in a first direction of rotation during engine shut down that is opposite a second direction of rotation of the cam lobe during normal engine operation.

2. The improvement as recited in claim 1 in which the contoured shaft has a substantially D-shaped cross-section formed by a curved surface and a flat surface that intersect at two, axially directed edges.

3. The improvement as recited in claim 2 in which the notch is formed by two curved surfaces that each mate with the curved surface of the contoured shaft, and the curved surfaces of the notch are offset from each other to form the step in the notch.

4. The improvement as recited in claim 3, wherein one of the axially directed edges and a portion of the flat surface of the contoured shaft rest against the step at least sometime when the contoured shaft is in the low speed orientation.

5. The improvement as recited in claim 4, wherein when pressure is applied upon the contoured shaft by a cam follower when the cam lobe moves in the first direction, the pressure tends to force the contoured shaft against one of the two curved surfaces, which serves to prevent the contoured shaft from moving so as to overcome the step.

6. The improvement as recited in claim 4, wherein when the cam lobe moves in the second direction and the cam lobe is accelerating from a low speed to a normal speed, the contoured shaft is rotated and lifted over the step.

7. The improvement as recited in claim 6, wherein the contoured shaft is configured to fit within a tube that has an internal region that is sufficiently large so as to allow the contoured shaft to align radially with each of the two curved surfaces.

8. The improvement as recited in claim 1, wherein the weight assembly and contoured shaft is at least one of: formed from a powdered material; formed from a metallic material; formed from a plastic material; and die cast.

9. A camshaft assembly comprising:

a cam lobe having a recess;

a cam gear coupled to the cam lobe; and an actuator assembly including a weight and a shaft coupled to one another;

wherein the actuator assembly is supported in relation to the cam lobe so that the shaft extends into the recess;

wherein the shaft of the actuator assembly is configured so that during low speed rotation of the cam lobe a protuberance formed by a portion of the shaft extends out of the recess beyond a perimeter of the cam lobe, and during normal speed rotation of the cam lobe the protuberance is at least one of reduced and eliminated; and wherein the recess includes two curved surfaces that are connected by a step surface, and the step surface restricts rotational movement of the shaft at least some of the time.

10. The camshaft assembly of claim 9, wherein the shaft has a substantially D-shaped cross-section formed by a curved surface and a flat surface that intersect at two, axially directed edges.

11. The camshaft assembly of claim 10, further comprising a cam follower that is in contact with at least one of the cam lobe and the shaft.

12. The camshaft assembly of claim 11, wherein when pressure is applied upon the shaft by the cam follower when the cam lobe moves in an abnormal direction of rotation that is opposite a normal direction of rotation, the pressure tends to force the contoured shaft against one of the two curved surfaces, which in turn serves to prevent the contoured shaft from rotating past the step.

13. The camshaft assembly of claim 9, further comprising a support structure on at least one of the cam lobe and the cam gear, wherein the actuator assembly is supported in relation to the cam lobe by way of the support structure so that the shaft extends into the recess of the cam lobe.

14. The camshaft assembly of claim 13, wherein the support structure includes a tube extending through the cam gear, and wherein the support structure supports the actuator assembly so that the weight is positioned along a first side of the cam gear and the shaft extends from the weight through the tube and out beyond a second side of the cam gear and into the recess of the cam lobe.

15. The camshaft assembly of claim 14, further comprising a spacer disposed around a central hub of the cam gear and extending radially outward therefrom to intercede between the actuator assembly and a portion of a housing so that the shaft of the actuator assembly is axially retained in the tube and in the recess.

16. The camshaft assembly of claim 9, further comprising means for biasing the weight of the actuator assembly toward an inner portion of the cam gear, wherein at high speeds of rotation of the cam gear and the cam lobe, centrifugal force causes the weight to move outward away from the inner portion of the cam gear in opposition to a biasing force provided by the means for biasing.

17. A method of operating a camshaft assembly, the method comprising:

decelerating a rotational speed of the camshaft assembly from a first speed to a second speed, wherein the camshaft assembly is rotating in a first rotational direction;

as the camshaft assembly is decelerating, rotating a shaft of an actuator assembly of the camshaft assembly within a recess of a cam lobe of the camshaft assembly, so that a protuberance appears on the cam lobe; and receiving an axially extending edge of the shaft adjacent to an axially extending step formed in the recess, wherein in at least one operational situation the shaft is prevented from rotating in a manner that would cause the edge to pass by the step.

18. The method of claim 17, wherein the at least one operational situation occurs when, after the camshaft assembly is decelerated, the camshaft assembly begins to rotation in a second rotational direction opposite the first rotational direction.

19. The method of claim 17, further comprising:

prior to the decelerating of the rotational speed, accelerating the rotational speed of the camshaft assembly from the second speed to the first speed; and as the camshaft assembly is accelerating, causing the shaft of the actuator assembly of the camshaft assembly to rotate within the recess of the cam lobe of the camshaft assembly, so that the protuberance is at least one of reduced and eliminated.

20. The method of claim 17, wherein the rotating of the shaft is caused by a spring that biases a weight portion of the actuator assembly toward an inner portion of the cam gear.

* * * * *